US008083485B2

(12) United States Patent
Chon et al.

(10) Patent No.: US 8,083,485 B2
(45) Date of Patent: Dec. 27, 2011

(54) ANGLED TRIPPED AIRFOIL PEANUT CAVITY

(75) Inventors: Young H. Chon, Farmington, CT (US); Dominic J. Mongillo, West Hartford, CT (US); Tracy A. Propheter-Hinckley, Manchester, CT (US); Joseph W. Bridges, Jr., Durham, CT (US)

(73) Assignee: United Technologies Corporation, Hartford, CT (US)

( * ) Notice: Subject to any disclaimer, the term of this patent is extended or adjusted under 35 U.S.C. 154(b) by 1375 days.

(21) Appl. No.: 11/893,320

(22) Filed: Aug. 15, 2007

(65) Prior Publication Data

US 2009/0047136 A1 Feb. 19, 2009

(51) Int. Cl.
*F01D 5/18* (2006.01)

(52) U.S. Cl. ..... 416/97 R

(58) Field of Classification Search ..... 415/115; 416/97 R

See application file for complete search history.

(56) References Cited

U.S. PATENT DOCUMENTS

| | | | | |
|---|---|---|---|---|
| 4,236,870 | A * | 12/1980 | Hucul et al. | 416/97 R |
| 4,416,585 | A | 11/1983 | Abdel-Messeh | |
| 4,474,532 | A | 10/1984 | Pazder | |
| 4,515,526 | A | 5/1985 | Levengood | |
| 4,604,031 | A | 8/1986 | Moss et al. | |
| 4,775,296 | A | 10/1988 | Schwarzmann et al. | |
| 4,786,233 | A | 11/1988 | Shizuya et al. | |
| 5,232,343 | A | 8/1993 | Butts | |
| 5,243,759 | A | 9/1993 | Brown et al. | |
| 5,395,212 | A | 3/1995 | Anzai et al. | |
| 5,431,537 | A | 7/1995 | Sturm | |
| 5,472,316 | A | 12/1995 | Taslim et al. | |
| 5,511,309 | A | 4/1996 | Beabout | |
| 5,667,359 | A | 9/1997 | Huber et al. | |
| 5,669,759 | A | 9/1997 | Beabout | |
| 5,681,144 | A | 10/1997 | Spring et al. | |
| 5,688,104 | A | 11/1997 | Beabout | |
| 5,700,131 | A | 12/1997 | Hall et al. | |
| 5,700,132 | A | 12/1997 | Lampes et al. | |
| 5,738,493 | A | 4/1998 | Lee et al. | |
| 5,857,837 | A | 1/1999 | Zelesky et al. | |
| 6,068,445 | A | 5/2000 | Beeck et al. | |
| 6,089,826 | A | 7/2000 | Tomita et al. | |

(Continued)

FOREIGN PATENT DOCUMENTS

EP 0907005 B1 9/2003

(Continued)

*Primary Examiner* — Edward Look
*Assistant Examiner* — Jesse Prager
(74) *Attorney, Agent, or Firm* — Kinney & Lange, P.A.

(57) ABSTRACT

A turbine airfoil comprises a wall portion, a cooling channel, an impingement rib, impingement rib nozzles, turbulators and leading edge cooling holes. The wall portion comprises a leading edge, a trailing edge, an outer diameter end, and an inner diameter end. The cooling channel receives cooling air and extends through an interior of the wall portion between the inner diameter end and the outer diameter end. The impingement rib is positioned within the wall portion forward of the cooling channel and between the outer diameter end and the inner diameter end to define a peanut cavity. The impingement rib nozzles extend through the impingement rib for receiving cooling air from the cooling channel. The turbulators are positioned within the peanut cavity to locally influence the flow of the cooling air. The leading edge cooling holes discharge the cooling air from the peanut cavity to an exterior of the wall portion.

21 Claims, 6 Drawing Sheets

U.S. PATENT DOCUMENTS

| | | | | |
|---|---|---|---|---|
| 6,168,380 | B1 | 1/2001 | Weigand | |
| 6,273,682 | B1 | 8/2001 | Lee | |
| 6,331,098 | B1 | 12/2001 | Lee | |
| 6,406,260 | B1 | 6/2002 | Trindade et al. | |
| 6,582,584 | B2 | 6/2003 | Lee et al. | |
| 6,634,858 | B2 | 10/2003 | Roeloffs et al. | |
| 6,672,836 | B2 | 1/2004 | Merry | |
| 6,808,367 | B1 | 10/2004 | Liang | |
| 6,884,036 | B2 | 4/2005 | Shi et al. | |
| 6,890,153 | B2 | 5/2005 | Demers | |
| 6,988,872 | B2 | 1/2006 | Soechting et al. | |
| 7,094,031 | B2 | 8/2006 | Lee et al. | |
| 7,163,373 | B2 | 1/2007 | Liang | |
| 7,195,448 | B2 | 3/2007 | Levine et al. | |
| 2006/0275118 | A1* | 12/2006 | Lee | 416/97 R |
| 2007/0128034 | A1* | 6/2007 | Lee et al. | 416/97 R |

FOREIGN PATENT DOCUMENTS

| | | | |
|---|---|---|---|
| EP | 0845580 | B1 | 4/2004 |
| EP | 1467065 | | 10/2004 |
| WO | WO96/12874 | | 5/1996 |
| WO | WO2005/083234 | A1 | 9/2005 |

* cited by examiner

ANGLED TRIPPED AIRFOIL PEANUT CAVITY

STATEMENT OF GOVERNMENT INTEREST

The U.S. Government has a paid-up license in this invention and the right in limited circumstances to require the patent owner to license others on reasonable terms as provided for by the terms of Contract No. N00019-02-C-3003 awarded by The United States Air Force.

BACKGROUND

Gas turbine engines operate by passing a volume of high energy gases through a plurality of stages of vanes and blades, each having an airfoil, in order to drive turbines to produce rotational shaft power. The shaft power is used to turn a turbine for driving a compressor to provide air to a combustion process to generate the high energy gases. Additionally, the shaft power is used to power a secondary turbine to, for example, drive a generator for producing electricity, or to produce high momentum gases for producing thrust. In order to produce gases having sufficient energy to drive both the compressor and the secondary turbine, it is necessary to combust the air at elevated temperatures and to compress the air to elevated pressures, which again increases the temperature. Thus, the vanes and blades are subjected to extremely high temperatures, often times exceeding the melting point of the alloys comprising the airfoils. In particular, the leading edges of the airfoils, which impinge most directly with the heated gases, are heated to the highest temperatures along the airfoil.

In order to maintain the airfoils at temperatures below their melting point it is necessary to, among other things, cool the airfoils with a supply of relatively cooler bypass air, typically siphoned from the compressor. The bypass cooling air is directed into the blade or vane to provide both impingement and transpiration cooling of the airfoil. Specifically, the bypass air is passed into the interior of the airfoil to remove heat from the alloy, and subsequently discharged through cooling holes to pass over the outer surface of the airfoil to prevent the hot gases from contacting the vane or blade. Various cooling air patterns and systems have been developed to ensure sufficient cooling of the leading edges of blades and turbines.

Typically, each airfoil includes a plurality of interior cooling channels that extend through the airfoil and receive the cooling air. Cooling holes are placed along the leading edge, trailing edge, pressure side and suction side of the airfoil to direct the interior cooling air out to the exterior surface of the airfoil. An impingement rib is often placed between the leading edge of the blade and the forward interior cooling channel, producing what is known as a leading edge exhaust passage, which is sometimes referred to as a "peanut cavity" due to its shape. The impingement rib accelerates the cooling air to a suitable velocity to permit the cooling air to exit the leading edge cooling holes and to increase heat transfer capacity of the cooling air. It is desirable to place the impingement rib close to the leading edge cooling holes to decrease the distance the cooling air must travel after exiting the impingement rib. Additionally, the further the impingement rib is from the leading edge of the airfoil, the greater the separation of the cooling air from the interior of the peanut cavity is, thus reducing the effective impingement cooling of the cooling air. It is, however, increasingly difficult to manufacture both the leading edge cooling holes and the impingement rib the closer the impingement rib is to the leading edge cooling holes. Thus, leading edge cooling design often results in a compromise in the positioning of the leading edge cooling holes and the impingement rib. Excessive leading edge heating can result in erosion of protective coatings or corrosion and spallation of the base alloy. There is, therefore, a need for improved leading edge airfoil cooling in vanes and blades of gas turbines.

SUMMARY

The present invention is directed toward a turbine airfoil, which comprises a wall portion, a cooling channel, an impingement rib, a plurality of impingement rib nozzles, a plurality of turbulators and a plurality of leading edge cooling holes. The wall portion comprises a leading edge, a trailing edge, an outer diameter end surface, and an inner diameter end surface. The cooling channel receives cooling air and extends through an interior of the wall portion between the inner diameter end surface and the outer diameter end surface. The impingement rib is positioned within the wall portion forward of the cooling channel and between the outer diameter end surface and the inner diameter end surface to define a peanut cavity. The plurality of impingement rib nozzles extend through the impingement rib for receiving cooling air from the cooling channel. The plurality of turbulators are positioned within the peanut cavity to locally influence the flow of the cooling air. The leading edge cooling holes discharge the cooling air from the peanut cavity to an exterior of the wall portion.

DETAILED DESCRIPTION

Figure 1:
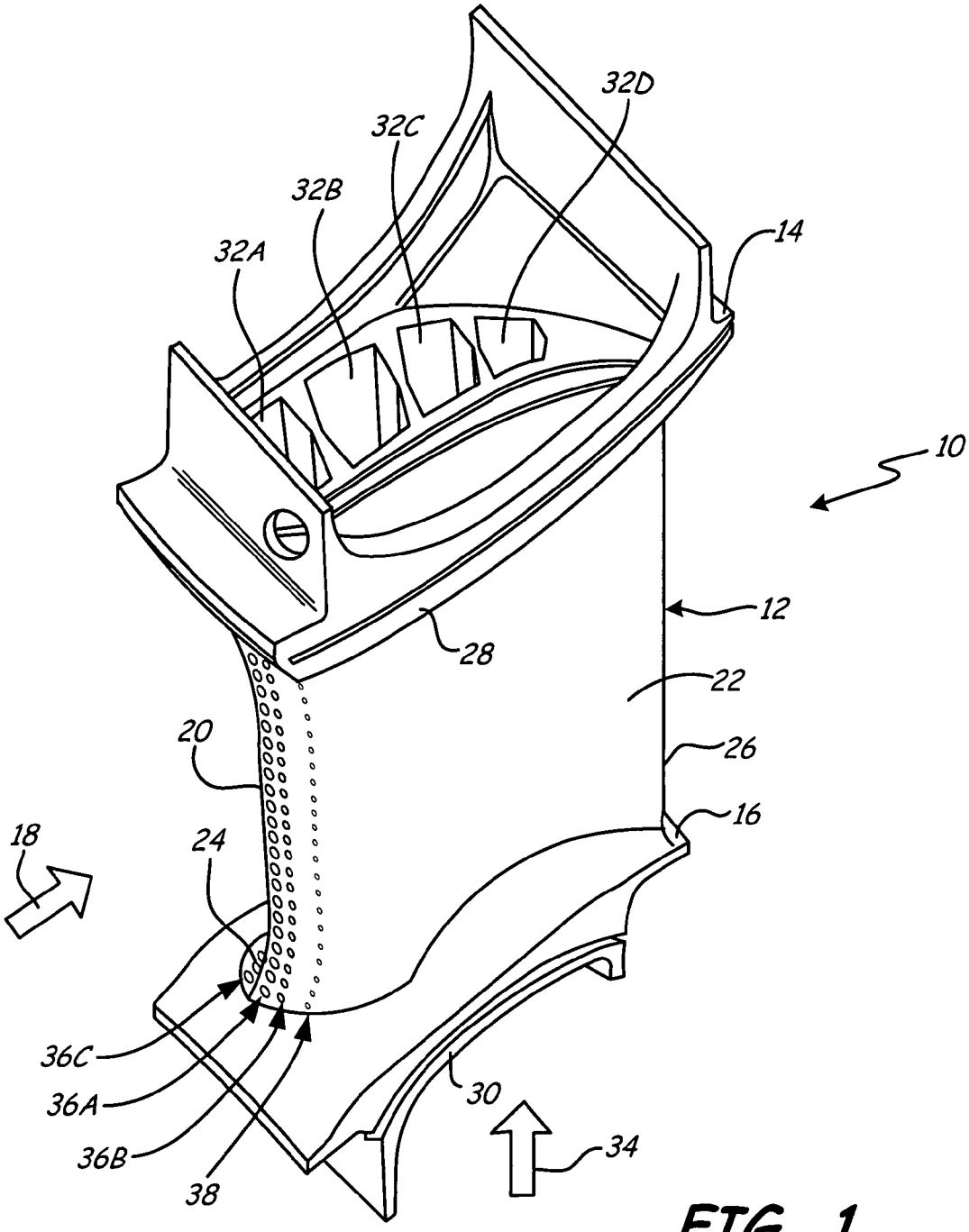
FIG. 1 shows a turbine airfoil in which the angled tripped peanut cavity of the present invention is used.

FIG. 1 shows stator 10 comprising airfoil 12, outer diameter shroud 14 and inner diameter shroud 16. Stator 10 comprises a typical stator vane that can be used in a compressor section or turbine section of a gas turbine engine. Although the invention is hereinafter described with respect to a stator vane, the invention is equally applicable to other airfoil structures such as rotor blades. Stator 10 generally functions to redirect the trajectory of passing air coming from a blade of one turbine stage to a blade of a subsequent turbine stage to increase engine efficiency. Vane shrouds, or platforms, 14 and 16 form outer and inner boundaries of the airflow path through the gas turbine engine and prevent leakage of air into and out of the airflow path to further improve engine efficiency.

In one embodiment of the invention, stator 10 comprises a high pressure turbine vane that is positioned downstream of a combustor section of a gas turbine engine to receive combustion gas 18. Airfoil 12 comprises a thin-walled structure that forms a hollow cavity having leading edge 20, pressure side 22, suction side 24 and trailing edge 26. The outer diameter end of airfoil 12 mates with shroud 28 and the inner diameter end of airfoil 12 mates with platform 30. Combustion gas 18 approaches leading edge 20 of stator 10 after passing through, for example, a first stage rotor blade. Vane 12 redirects the flow of gas 18 such that, after passing by trailing edge 26, the incidence of air 18 on the second stage rotor blade stage is optimized.

Due to the extremely elevated temperatures of combustion gas 18, it is necessary to employ means for cooling stator 10. Stator 10 includes cooling passages 32A, 32B, 32C and 32D, which include openings in outer diameter shroud 14 and inner diameter shroud 16 and extend through airfoil 12. As such, cooling air 34 can be directed through vane 10 to perform impingement cooling on the interior of airfoil 12, before being supplied to other engine components or being passed out of the engine. Stator 10 also includes leading edge (LE) cooling holes 36A, 36B and 36C, and gill holes 38 to perform film cooling on the exterior of airfoil 12. LE cooling holes 36A and 36B and gill holes 38 allow cooling air 34 to escape near and at leading edge 20 of airfoil 12 to form a barrier of cooling air 34 along pressure side 22 and suction side 24 of airfoil 12. Cooling air 34 is transferred from cooling channel 32A to LE cooling holes 36A, 36B and 36C and gill holes 38 through a peanut cavity positioned at leading edge 20 of airfoil 12. LE cooling holes 36A-36C and gill holes 38 extend through airfoil 12 and into the peanut cavity to allow cooling air 34 to escape from the interior of stator vane 10. The peanut cavity includes trip strips or other turbulators such that the cooling air is more effectively and efficiently transferred from cooling channel 32A to the exterior of airfoil 12.

Figure 2:
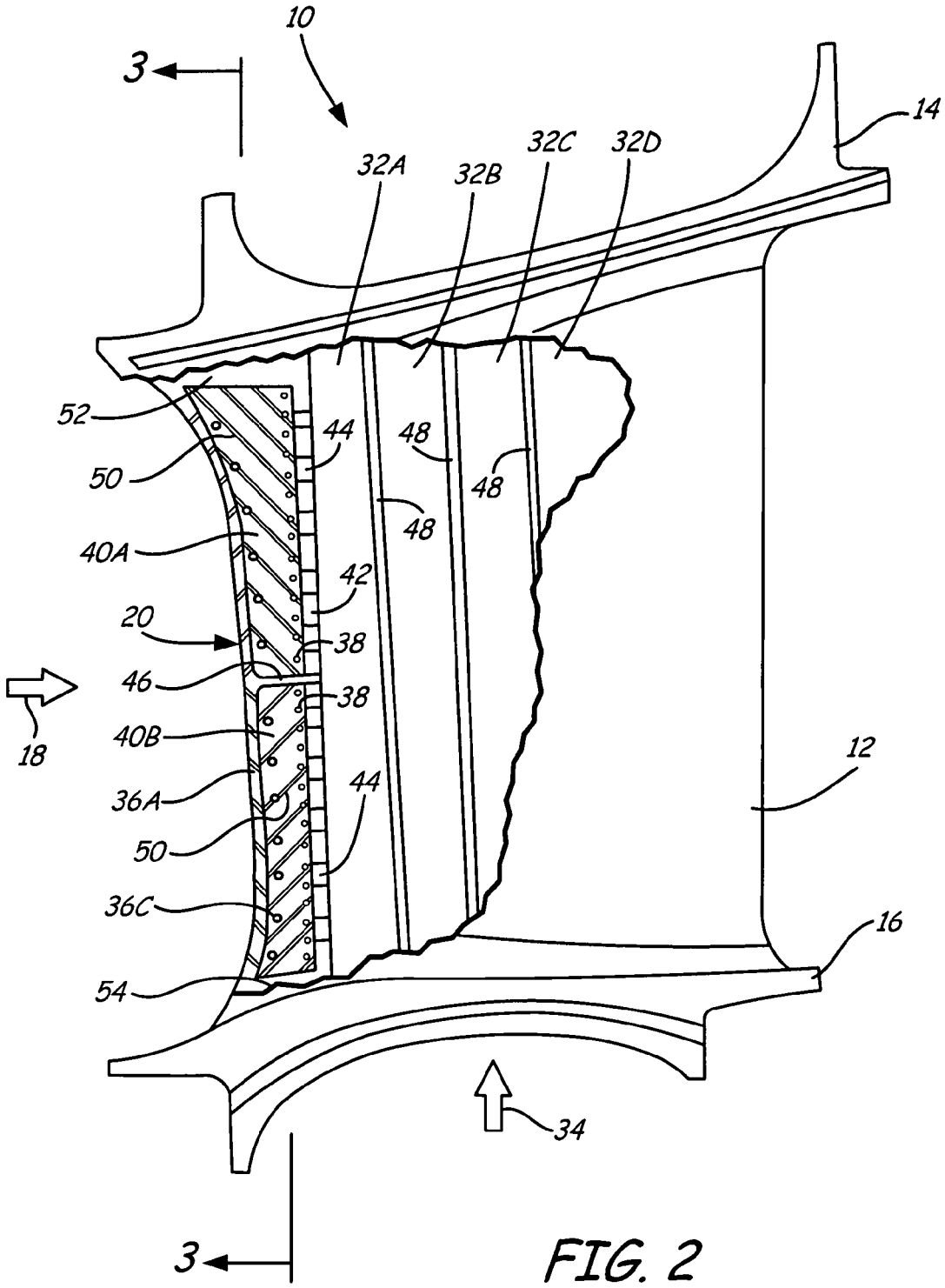
FIG. 2 shows a partially cutaway view of the turbine airfoil of FIG. 1 in which the peanut cavity is shown.

FIG. 2 shows a partially cutaway view of stator 10 of FIG. 1 in which peanut cavities 40A and 40B of peanut cavity 40 are shown. Stator vane 10 includes exterior air directing features including airfoil 12, outer diameter shroud 14 and inner diameter shroud 16. Stator vane 10 includes interior cooling features including cooling channels 32A-32D, LE cooling holes 36A-36C, gill holes 38, peanut cavities 40A and 40B, impingement rib 42, nozzles 44, divider 46, partitions 48, trip strips 50, outer diameter end cap 52 and inner diameter end cap 54.

Airfoil 12 includes cooling channels 32A-32D and partitions 48 that form a cooling network within airfoil 12 and strengthen airfoil 12 to withstand the temperatures and forces sustained during operation of a gas turbine engine. Partitions 48, also known as ribs or dividers, extend from pressure side 22 to suction side 24 of airfoil 12 to divide the interior of airfoil 12 into cooling channels 32A-32D, while also providing structural support to airfoil 12. For example, cooling air 34 enters cooling channels 32A through 32D from either the inner diameter or outer diameter end of airfoil 12. Cooling channels 32A-32D include openings at both the inner diameter end and outer diameter end of airfoil 12, within shrouds 14 and 16, such that cooling air 34 is able to freely pass through airfoil 12 and transfer heat away. In other embodiments, cooling channels 32A-32D may be configured in a serpentine configuration. The forward end of cooling channel 32A adjoins impingement rib 42, which includes nozzles 44 so that cooling air 34 can be directed into peanut cavities 40A and 40B at the leading edge of airfoil 12.

Peanut cavities 40A and 40B are positioned within airfoil 12 between leading edge 20 and impingement rib 42, and between outer diameter end cap 52 and inner diameter end cap 54 such that peanut cavities 40A and 40B comprise enclosed interior cooling chambers. Cooling air 34 from cooling channel 32A has access to peanut cavities 40A and 40B through nozzles 44 in impingement rib 42. Nozzles 44 accelerate cooling air 34 as it travels toward leading edge 20 of airfoil 12. Due to the pressure differential produced during operation of the gas turbine engine between peanut cavities 40A and 40B and the exterior of stator vane 10, cooling air 34 is pushed out of LE cooling holes 36A, 36B and 36C and gill holes 38. Due to outer diameter end cap 52 and inner diameter end cap 54, cooling air 34 does not enter peanut cavity 40 from the outer or inner diameter end of airfoil 12. Thus, a crosscurrent is not produced and cooling air 34 is allowed to travel generally straight to LE cooling holes 36A-36C from nozzles 44.

Gill holes 38 act to pull cooling air 34 closer to the interior wall of airfoil 12 while traveling through peanut cavities 40A and 40B. In various embodiments, angled trip strips 50 act to slow down or accelerate cooling air 34 as cooling air 34 enters LE cooling holes 36A, 36B and 36C. Divider 46 separates peanut cavity 40 into upper and lower peanut cavities 40A and 40B, respectively, such that the flow of cooling air 34 can be independently controlled for each of the outer and inner diameter ends of airfoil 12. For example, in peanut cavity 40A, cooling holes 32A are directed toward the inner diameter end of airfoil 12, while in peanut cavity 40B, cooling holes 36A are directed toward the outer diameter end of airfoil 12. Additionally, nozzles 44 in impingement rib 42 may be differently sized in peanut cavities 40A and 40B to produce different pressures within each cavity.

Figure 3:
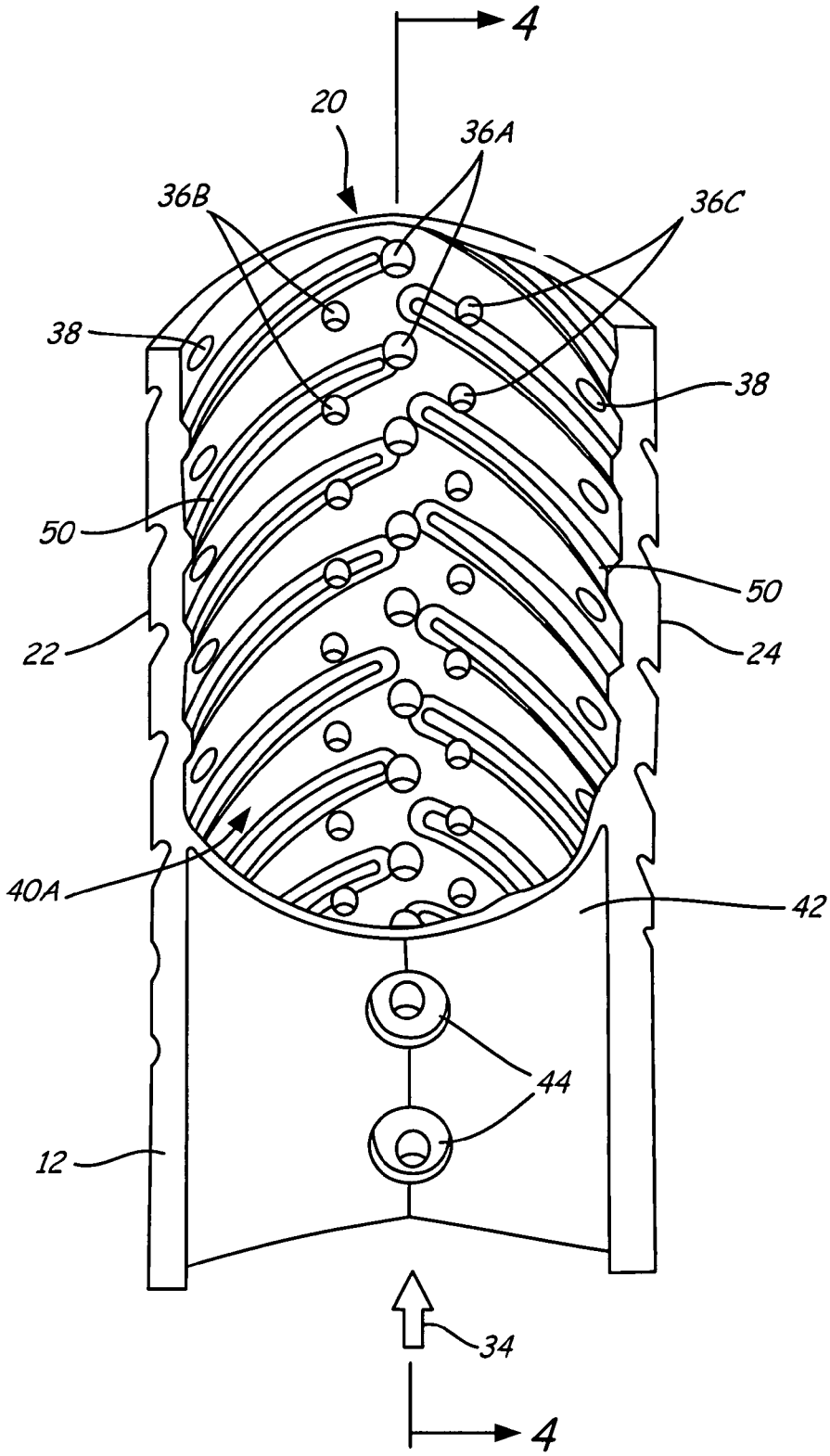
FIG. 3 shows a cutaway portion of the turbine airfoil of FIG. 2 in which trip strips and cooling holes are seen in the interior of the peanut cavity.

FIG. 3 shows a cutaway portion of airfoil 12 taken at section 3-3 of peanut cavity 40A in FIG. 2. FIG. 3 shows the trailing edge side of impingement rib 42, while looking forward into peanut cavity 40A. Within peanut cavity 40A, trip strips 50 are arranged around the interior surface of airfoil 12. Likewise, LE cooling holes 36A, 36B and 36C extend from the interior surface of airfoil 12 to the exterior surface. In the embodiment shown, LE cooling holes 36A, 36B and 36C extend at an angel through airfoil 12 down toward the inner diameter end of vane 10. Gill holes 38 extend from the interior surface of airfoil 12 back toward impingement rib 42.

Cooling air 34 enters peanut cavity 40A through nozzles 44, which compress and expand cooling air 34 as it passes through impingement rib 42. Since cooling air 34 is only permitted to enter peanut cavity 40A through nozzles 44, cooling air 34 has a tendency to travel straight towards leading edge 20 while dispersing out toward pressure side 22 and suction side 24 such that cooling air 34 forms a generally cone shaped distribution from each nozzle 44 within peanut cavity 40A. However, peanut cavity 40A is generally rectilinear near impingement rib 42 such that cooling air 34 does not naturally flow into the aft portion of peanut cavity 40A next to impingement rib 42. As such, cooling air 34 generally forms a recirculating pattern in the corners of peanut cavity 40A near impingement rib 42, reducing the capacity of cooling air 34 to remove heat from airfoil 12. It is, therefore, generally desirable to place impingement rib 42 close to leading edge 20. This permits cooling air 34 to flow across a greater portion of the interior surface of peanut cavity 40A, and prevents cooling air 34 from impinging on leading edge 20 at a reduced velocity, both of which increase the impingement cooling effectiveness of cooling air 34. However, because of manufacturing issues, impingement rib 42 must be maintained some distance away from leading edge 20, which is further increased by the addition of gill holes 38.

Gill holes 38, which are placed alongside the impingement rib in columns often referred to as "gill rows," allow cooling air 34 to escape peanut cavity 40A directly to pressure side 22 and suction side 24 to perform transpiration cooling of airfoil 12. Gill holes 38 are placed just forward of impingement rib 42 and extend to the exterior of airfoil 12. Gill holes 38 also influence the flow of cooling air 34 across the interior surface of peanut cavity 40A. Because gill holes 38 are placed near impingement rib 42, gill holes 38 have the beneficial effect of pulling cooling air 34 into contact with the interior of peanut cavity 40A. Thus, more of cooling air 34 reaches the aft portions of peanut cavity 40A, which eliminates recirculation patterns and increases the heat transfer capacity of cooling air 34. Gill holes 38, however, have the deleterious effect of pushing impingement rib 42 further back from leading edge 20. For example, airfoil 12 is cast with impingement rib 42, while LE cooling holes 36A, 36B and 36C, and gill holes 38 are subsequently drilled into airfoil 12. Impingement rib 42 must be placed a minimal axial length away from leading edge 20 in order to provide additional surface area to accommodate drill tolerance requirements. Additionally, gill holes 38 also disrupt the flow of cooling air 34 from impingement rib 42 to LE cooling holes 36A, 36B and 36C. Thus, due to manufacturing concerns and the presence of gill holes 38, it is difficult to optimize the velocity and trajectory of cooling air 34 as it enters LE cooling holes 36A, 36B and 36C, thereby negatively affecting the impingement heat transfer coefficient of cooling air 34.

Due to the lack of available surface area within the peanut cavity, conventional airfoil designs do not incorporate turbulation features such as trip strips within the peanut cavity. In such embodiments, leading edge cooling of the airfoil is primarily obtained from the jet of cooling air exiting the nozzles in the impingement rib such that cooling of the suction side and pressure side of the leading edge portion of the airfoil is achieved by the dispersing of the cooling air as it exits the nozzles. Airfoil 12 of the present invention is provided with turbulation features, such as trip strips 50, and gill holes 38 along the interior wall of peanut cavity 40A to mitigate the reduction in internal peak and sidewall convective heat transfer coefficient due to the required distance impingement rib 42 must be placed from leading edge 20 to accommodate manufacture of vane 10. Specifically, in one embodiment, trip strips 50 are used to tune the flow characteristics of cooling air 34 as it enters LE cooling holes 36A, 36B and 36C, and to increase the heat transfer coefficient of cooling air 34 as it passes along the interior wall of airfoil 12. In the embodiment shown, peanut cavity 40A comprises two columns of trip strips 50, one on pressure side 22 and one on suction side 24. Trip strips 50 begin at the forward side of impingement rib 42 and wrap around toward the leading edge of airfoil 12. Trip strips 50 converge at leading edge 20 to direct cooling air 34 into LE cooling holes 36A-36C.

Figure 4:
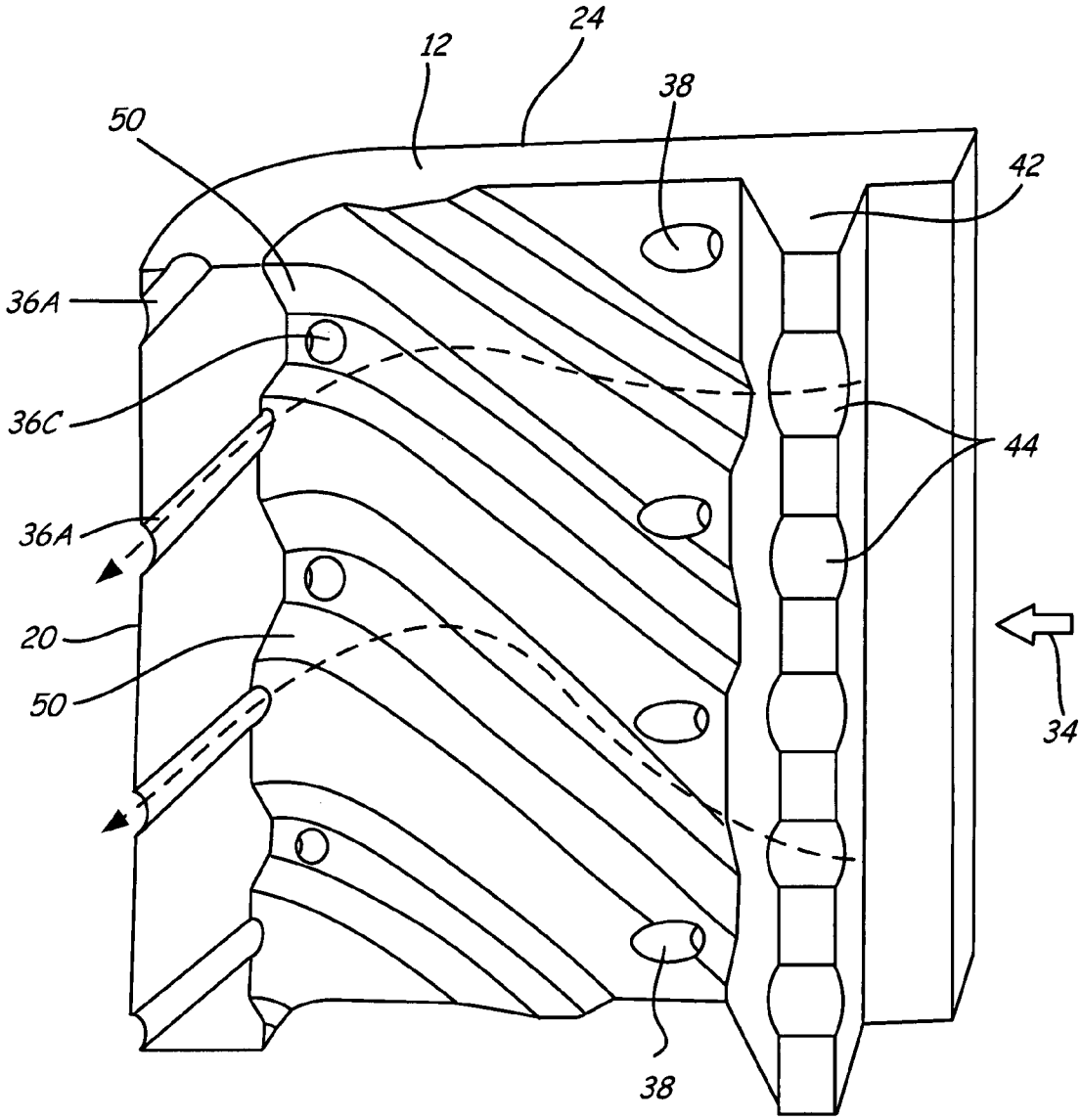
FIG. 4 shows a cross-section through the portion of the turbine airfoil of FIG. 3 showing a first embodiment of the angled trip strips and the cooling holes.

FIG. 4 shows a cross-section of airfoil 12 taken at section 4-4 of FIG. 3 showing a first embodiment of airfoil 12 in which trip strips 50 are configured to slow cooling air 34 before entering leading edge cooling holes 36A, 36B and 36C. As described with respect to FIG. 3, cooling air 34 is directed into peanut cavity 40A through nozzles 44 of impingement rib 42. Cooling air 34 is pulled into contact with the interior wall of airfoil 12 by gill holes 38. Trip strips 50 are provided along the interior wall of airfoil 12 to induce a desired exit velocity of cooling air 34 as it leaves peanut cavity 40A at LE cooling holes 36A, 36B and 36C. Trip strips 50 also increase the local convective heat transfer coefficient and thermal cooling effectiveness at leading edge 20 of airfoil 12 by increasing the turbulence and mixing of cooling air 34 as it mixes with the boundary layer air along the interior wall of airfoil 12. Additionally, trip strips 50 increase the internal surface area of peanut cavity 40A, which allows for additional convective heat transfer from airfoil 12 to cooling air 34, further increasing the convective efficiency of airfoil 12 at leading edge 20.

Trip strips 50 are angled to direct cooling air 34 from the aft portion of peanut cavity 40A toward LE cooling holes 36A, 36B and 36C. LE cooling holes 36A are placed near leading edge 20 of airfoil 12 between trip strips 50. LE cooling holes 36C are placed toward pressure side 24 of leading edge cooling holes 36A within trip strips 50. LE cooling holes 36B (FIG. 3) are placed toward suction side 22 of leading edge cooling holes 36A within trip strips 50. In other embodiments, however, the position of LE cooling holes 36A, 36B and 36C may be non-uniformly placed or placed in other positions. In the embodiment shown in FIG. 4, trip strips 50 are sloped up toward the outer diameter end of airfoil 12 as they extend from impingement rib 42. LE cooling holes 36A, 36B and 36C are sloped down toward the inner diameter end of airfoil 12 as they extend from the interior of airfoil 12. As such, the trajectory of cooling air 34 must be redirected before entering LE cooling holes 36A and 36C, thus slowing the speed at which cooling air 34 enters LE cooling holes 36A, 36B and 36C. The angle between trip strips 50 and LE cooling holes 36A, 36B and 36C can be adjusted based on design needs by adjusting the angle of trip strips 50, the angle of LE cooling holes 36A-36C, or both. Additionally, the suction of LE cooling holes 36A, 36B and 36C introduces a downward component into the velocity of cooling air 34, which pulls cooling air 34 transversely across trip strips 50 to further slow it down. The slowing of cooling air 34 increases the residence time of cooling air 34 within peanut cavity 40A thereby increasing convective heat transfer from airfoil 12. This embodiment is readily applicable to cooling configurations in which pressure loss across LE cooling holes 36A, 36B and 36C and leading edge backflow margin is not a concern. However, in other embodiments, the orientation of trip strips 50 within peanut cavity 40 can be altered to minimize internal pressure loss rather than to maximize internal convective heat transfer.

Figure 5:
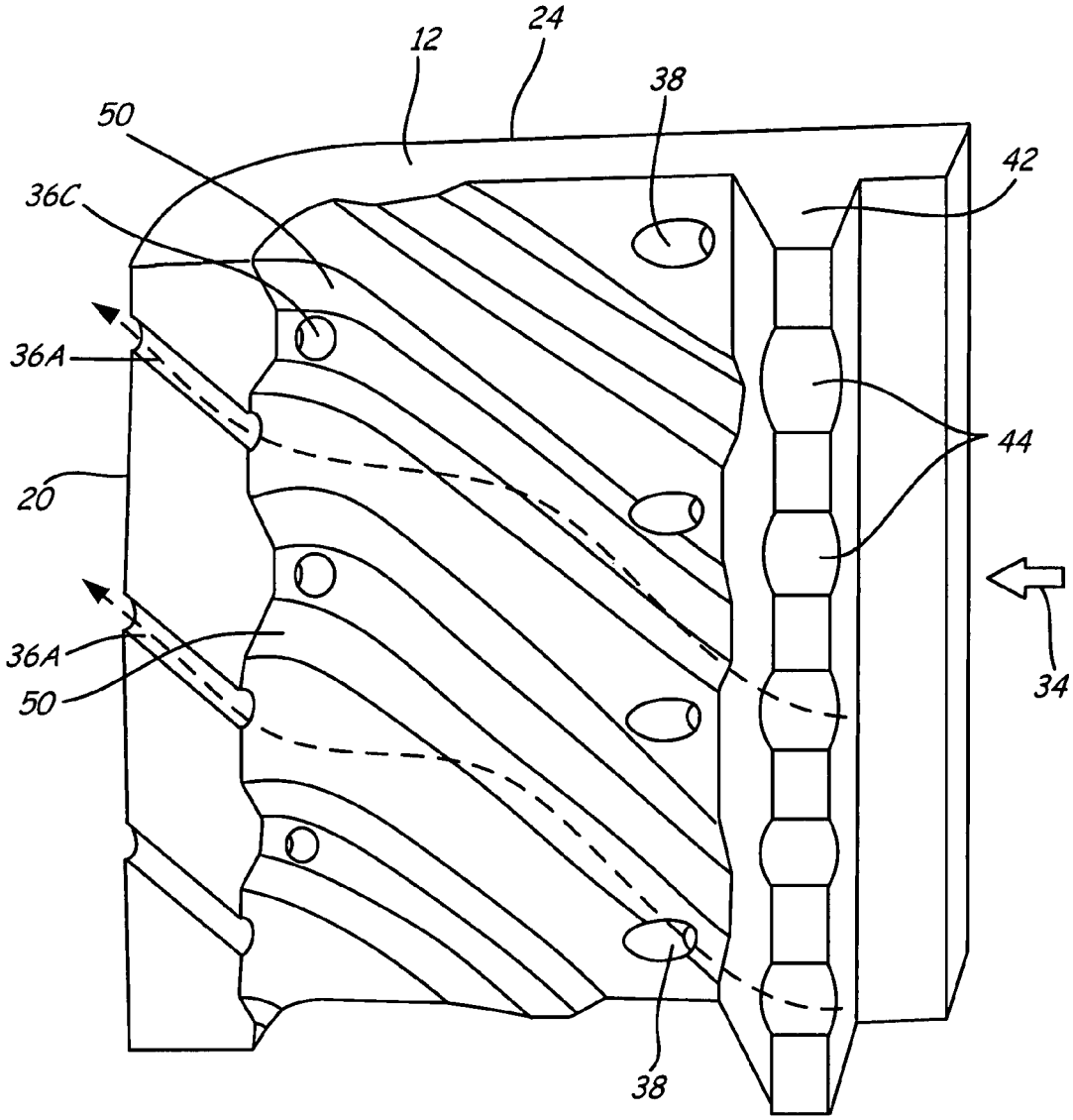
FIG. 5 shows a second embodiment of the angled trip strips and the cooling holes in the peanut cavity of the present invention

FIG. 5 shows a cross-section of airfoil 12 taken at section 4-4 of FIG. 3 showing a second embodiment of trip strips 50 in which they are configured to guide cooling air 34 generally straight into LE cooling holes 36A, 36B and 36C. In the embodiment shown in FIG. 5, trip strips 50 are sloped up toward the outer diameter end of airfoil 12 as they extend from impingement rib 42. LE cooling holes 36A, 36B and 36C are also sloped up toward the outer diameter end of airfoil 12 as they extend from the interior of airfoil 12. As such, the trajectory of cooling air 34 is guided into LE cooling holes 36A, 36B and 36C, thus not interfering with the speed or trajectory at which cooling air 34 enters LE cooling holes 36A, 36B and 36C. Therefore, the suction of LE cooling holes 36A, 36B and 36C pulls cooling air 34 along the trajectory of trip strips 50 reducing the volume of cooling air 34 that is pulled across trip strips 50. Thus, cooling air 34 is permitted to enter LE cooling holes 34A, 36B and 34C at much higher velocities than in the embodiment of FIG. 4, reducing the residence time of cooling air 34 within peanut cavity 40A. This reduces the convective heat transfer from airfoil 12, but pressure loss across LE cooling holes 36A, 36B and 36C is reduced. Backflow margin is also decreased as pressure within peanut cavity 40A is maintained. This embodiment is readily applicable to cooling configurations in which high thermal cooling effectiveness in not required. Trip strips 50 are shown as being quadrangular in shape having three flat surfaces in addition to the surface along airfoil 12. However, in other embodiments, other shaped turbulators may be used in place of trip strips 50.

Figure 6:
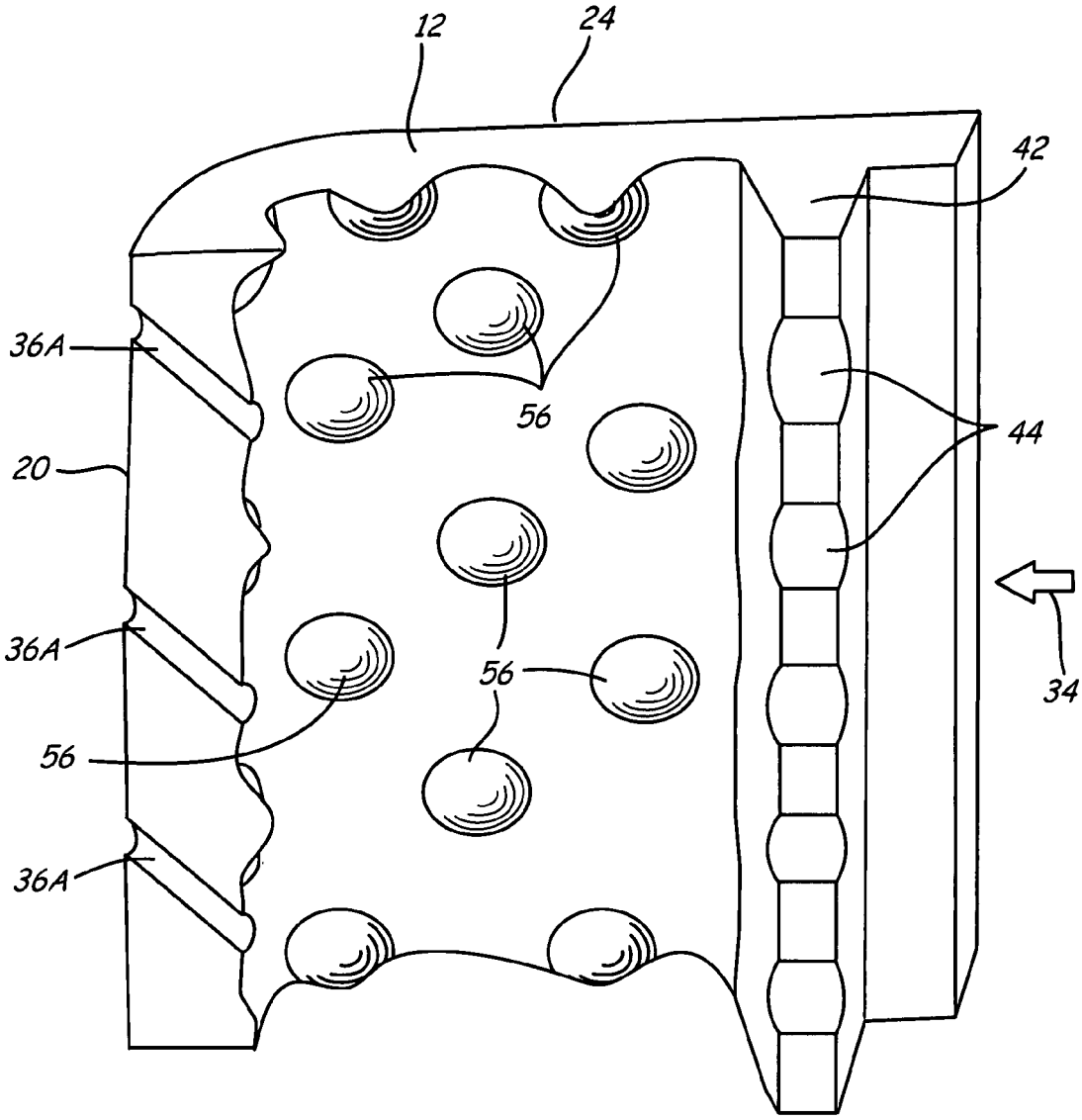
FIG. 6 shows an embodiment of the present invention in which alternatively shaped turbulators are used in the peanut cavity.

FIG. 6 shows an alternative embodiment of the present invention, in which peanut cavity 40A includes circular shaped turbulators 56 distributed along the interior wall of airfoil 12. Turbulators 56 comprise spherical protrusions or bumps along the surface of peanut cavity 40A. Turbulators 56 are dispersed along the interior wall of airfoil 12 in a uniform pattern. In other embodiments, turbulators 56 are dispersed in a random pattern having either a uniform or random pattern. In still other embodiments, turbulators 56 can be placed in rows to mimic trip strips 50. In other embodiments, various shaped turbulators can be used such as pedestals or fins of various shapes and sizes. Turbulators 56 provide an effective means for achieving efficient convective heat transfer cooling of airfoil 12 while minimizing internal pressure loss within peanut cavity 40A. Turbulators 56 are also beneficially used with slow flowing cooling air that does not need to be further slowed after passing through peanut cavity 40.

Although the present invention has been described with reference to preferred embodiments, workers skilled in the art will recognize that changes may be made in form and detail without departing from the spirit and scope of the invention.

The invention claimed is:

1. A turbine airfoil comprising:

a wall portion comprising:

a leading edge;

a trailing edge;

a suction side;

a pressure side;

an outer diameter end surface; and an inner diameter end surface;

a cooling channel for receiving cooling air extending through an interior of the wall portion between the outer diameter end surface and the inner diameter end surface;

an impingement rib positioned within the wall portion forward of the cooling channel and between the outer diameter end surface and the inner diameter end surface to define a peanut cavity;

a plurality of impingement rib nozzles extending through the impingement rib for receiving cooling air from the cooling channel;

a shelf dividing the peanut cavity into an upper chamber and a lower chamber;

a plurality of turbulators positioned within the peanut cavity to locally influence the flow of the cooling air, the plurality of turbulators comprising:

a first column of trip strips extending along the suction side in the upper and lower chambers, each trip strip beginning at the impingement rib and extending to the leading edge; and a second column of trip strips extending along the pressure side in the upper and lower chambers, each trip strip beginning at the impingement rib and extending to the leading edge;

wherein each trip strip in the upper chamber is angled toward the outer diameter end surface and each trip strip in the lower chamber is angled toward the inner diameter end surface;

a plurality of gill holes extending through the wall and comprising:

a first column of gill holes extending along the suction side adjacent the impingement rib within the upper and lower chambers; and a second column of gill holes extending along the pressure side adjacent the impingement rib within the upper and lower chambers; and a plurality of leading edge cooling holes, including only a single column of cooling holes disposed between the first and second columns of trip strips at a tip of the leading edge, to discharge the cooling air from the peanut cavity to an exterior of the wall.

2. The turbine airfoil of claim 1 wherein the leading edge cooling holes are skewed toward either the inner diameter end surface of the wall or the outer diameter end surface of the wall.

3. The turbine airfoil of claim 2 wherein the trip strips are aligned with the skew of the leading edge cooling holes such that the cooling air is directed into the leading edge cooling holes.

4. The turbine airfoil of claim 2 wherein the trip strips are aligned against the skew of the leading edge cooling holes such that the cooling air is redirected before exiting at the leading edge cooling holes.

5. The turbine airfoil of claim 2 wherein the trip strips are angled such that the cooling air travels transversely across the trip strips before exiting at the leading edge cooling holes.

6. The turbine airfoil of claim 1 wherein the cooling channel extends through the inner diameter end surface and through the outer diameter end surface.

7. A turbine airfoil comprising:

a wall defining a leading edge, a trailing edge, a pressure side, a suction side, an outer diameter end and an inner diameter end;

a divider extending along the interior surface of the hollow airfoil portion to define a cooling channel within the wall;

an impingement rib positioned between the divider and the leading edge of the wall to define an interior cooling chamber;

an outer diameter cap enclosing an outer diameter of the interior cooling chamber;

an inner diameter cap enclosing an inner diameter of the interior cooling chamber;

a plurality of impingement holes positioned along the impingement rib for allowing cooling air from the cooling channel to enter the interior cooling chamber;

a shelf dividing the interior cooling chamber into an upper chamber and a lower chamber;

a plurality of turbulators positioned within the interior cooling chamber to promote turbulence in the cooling air along an interior of the wall, the plurality of turbulators comprising:

a first column of trip strips extending along a suction side of the upper and lower chambers; and a second column of trip strips extending along a pressure side of the upper and lower chambers;

wherein each trip strip in the upper chamber is angled toward the outer diameter cap and each trip strip in the lower chamber is angled toward the inner diameter cap; and a plurality of columns of leading edge cooling holes disposed within the first and second columns of trip strips to discharge the cooling air from the interior cooling chamber to an exterior of the wall.

8. The turbine airfoil of claim 7 wherein the leading edge cooling holes are angled toward either the inner diameter cap or the outer diameter cap.

9. The turbine airfoil of claim 8 wherein the trip strips have the same angle as the leading edge cooling holes.

10. The turbine airfoil of claim 7 wherein the trip strips funnel the cooling air toward the leading edge of the wall.

11. The turbine airfoil of claim 7 wherein the leading edge cooling holes extend through the trip strips.

12. The turbine airfoil of claim 7 and further comprising a plurality of gill holes extending from within the interior cooling chamber through to the exterior of the wall, wherein the gill holes are positioned between the trip strips, the plurality of gill holes comprising:

a first column of gill holes extending along the suction side adjacent the impingement rib within the upper and lower chambers; and a second column of gill holes extending along the pressure side adjacent the impingement rib within the upper and lower chambers.

13. An airfoil for use in a turbine blade or vane, the airfoil comprising:

an airfoil body shaped to have a peanut cavity enclosed between a leading edge of the airfoil body, an impingement rib, an inner shroud portion and an outer shroud portion;

a shelf dividing the peanut cavity into an upper chamber and a lower chamber;

a plurality of cooling bores positioned along the impingement rib for allowing cooling air into the upper and lower chambers of the peanut cavity;

a plurality of turbulators positioned along the airfoil body within the upper and lower chambers of the peanut cavity to influence flow of the cooling air along the airfoil body, wherein each of the turbulators in the upper chamber are angled forward and outward and each of the turbulators in the lower chamber are angled forward and inward; and a plurality of cooling holes positioned along the leading edge of the airfoil body in the upper and lower chambers to discharge the cooling air from the peanut cavity.

14. The airfoil of claim 13 and further comprising a plurality of gill holes positioned forward of the impingement rib within the peanut cavity.

15. The turbine airfoil of claim 1 wherein the plurality of leading edge cooling holes comprises:

a first column segment of cooling holes disposed within the upper chamber that are angled radially outward toward the outer diameter end surface; and a second column segment of cooling holes disposed within the lower chamber that are angled radially inward toward the inner diameter end surface.

16. The turbine airfoil of claim 1 wherein the plurality of leading edge cooling holes comprises:

a first column segment of cooling holes disposed within the upper chamber that are angled radially inward toward the inner diameter end surface; and a second column segment of cooling holes disposed within the lower chamber that are angled radially outward toward the outer diameter end surface.

17. The turbine airfoil of claim 8 wherein the trip strips have the opposite angle as the leading edge cooling holes.

18. The turbine airfoil of claim 7 wherein the cooling channel extends through the outer diameter end and the inner diameter end of the wall.

19. The airfoil of claim 13 wherein the plurality of turbulators are arranged in a pair of columns each extending through the upper and lower chambers such that a column of the plurality of cooling holes is positioned between the pair of columns of turbulators.

20. The air foil of claim 13 wherein the plurality of cooling holes in the upper chamber are angled forward and inward, and the plurality of cooling holes in the lower chamber are angled forward and outward.

21. The air foil of claim 13 wherein the plurality of cooling holes in the upper chamber are angled forward and outward, and the plurality of cooling holes in the lower chamber are angled forward and inward.

* * * * *